US005813372A

United States Patent [19]

Manthey

[11] Patent Number: 5,813,372

[45] Date of Patent: Sep. 29, 1998

[54] AXIAL PISTON ROTARY ENGINE

[75] Inventor: Steven Charles Manthey, Currumbin Valley, Australia

[73] Assignee: Advanced Engine Technology Pty Ltd., Burleigh Gardens, Australia

[21] Appl. No.: 737,056

[22] PCT Filed: Dec. 4, 1995

[86] PCT No.: PCT/AU95/00815

§ 371 Date: Oct. 24, 1996

§ 102(e) Date: Oct. 24, 1996

[87] PCT Pub. No.: WO96/17162

PCT Pub. Date: Jun. 6, 1996

[30] Foreign Application Priority Data

Dec. 2, 1994 [AU] Australia ..... PM 9827

[51] Int. Cl.[6] ..... F02B 57/00

[52] U.S. Cl. ..... 123/43 A; 123/43 AA; 123/43 C

[58] Field of Search ..... 123/43 A, 43 AA, 123/43 C, 43 R, 44 R, 44 B, 44 E

[56] References Cited

U.S. PATENT DOCUMENTS

| | | | |
|---|---|---|---|
| 3,807,370 | 4/1974 | Baugh | 123/43 C |
| 4,022,167 | 5/1977 | Kristiansen | 123/43 AA |
| 4,287,858 | 9/1981 | Anzalone | 123/43 AA |
| 5,103,778 | 4/1992 | Usich | 123/43 AA |
| 5,209,190 | 5/1993 | Paul | 123/43 AA |

*Primary Examiner*—Marguerite McMahon
*Attorney, Agent, or Firm*—Abelman, Frayne & Schwab

[57] ABSTRACT

A rotary internal combustion engine of the type having pistons mounted for reciprocatory movement in respective cylinders which are arranged in equally-spaced relationship around a longitudinal axis of rotation, said axis being the axis of rotation of an output shaft passing rotatably and sealably through apertures of respective first and second end plates of a housing within which the pistons and cylinders move as part of a rotatable rotor assembly secured to said output shaft, while the pistons are simultaneously movable reciprocably in the cylinders, cam follower means being associated with each piston and adapted to coact with undulating cam track means around the housing. Cyclical combustion of fuel in the cylinders imparts reciprocation to the pistons with resultant thrust against the cam track means so as to cause rotation of the rotor assembly and output shaft. The pistons include two sets thereof each having at least two pistons, the pistons of each set being at opposite sides of the axis of rotation of the rotor assembly and output shaft and are interconnected by piston-connection means to that the pistons of each set move in unison, the parts being so made and arranged that the piston cam follower means coact with the cam track means in a manner ensuring that movement of either set of pistons in their cylinders is in the direction opposite to the direction of movement of the other set of pistons.

20 Claims, 14 Drawing Sheets

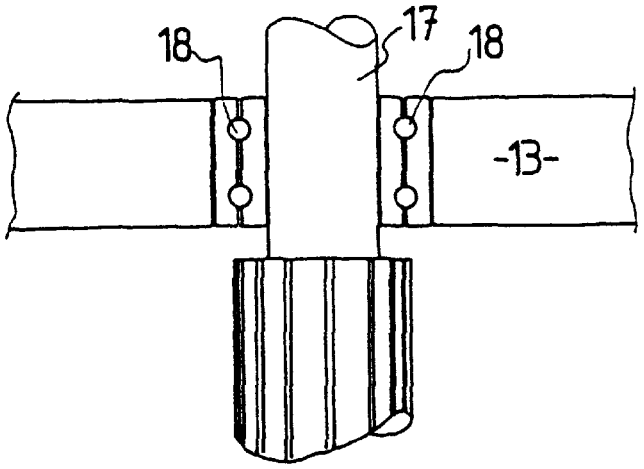
FIG. 3
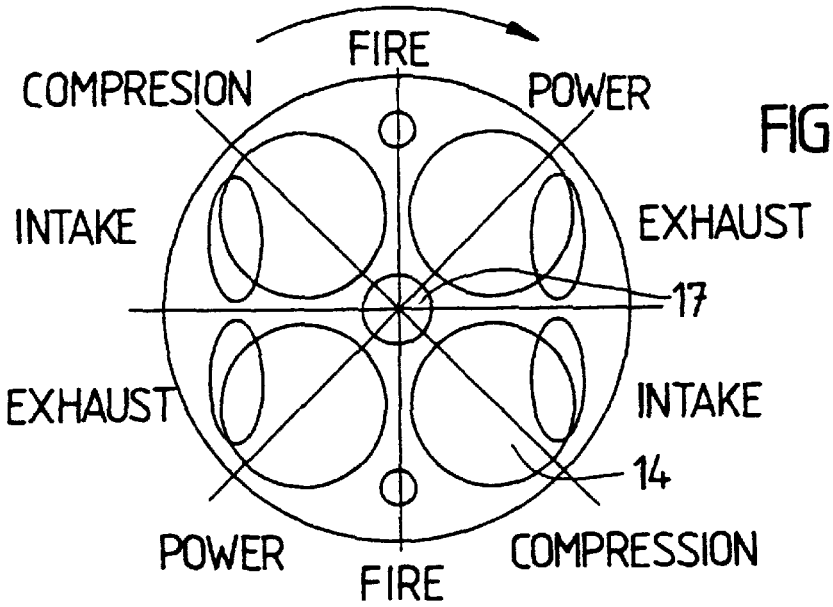
FIG. 4
PRIOR ART
FIG. 5
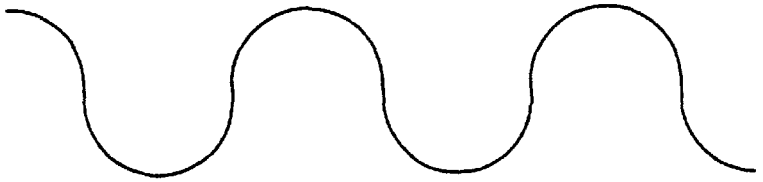
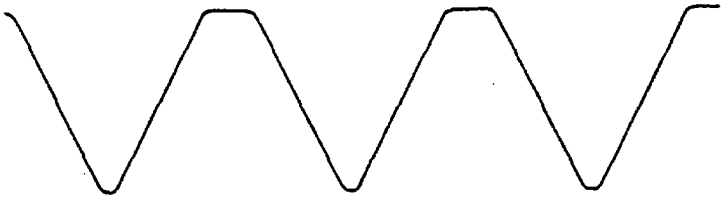

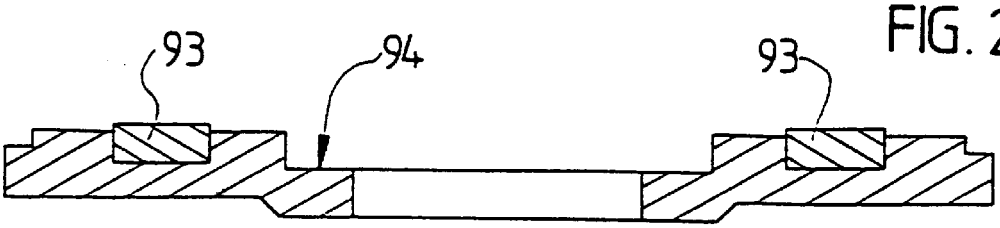
FIG. 27
FIG. 28
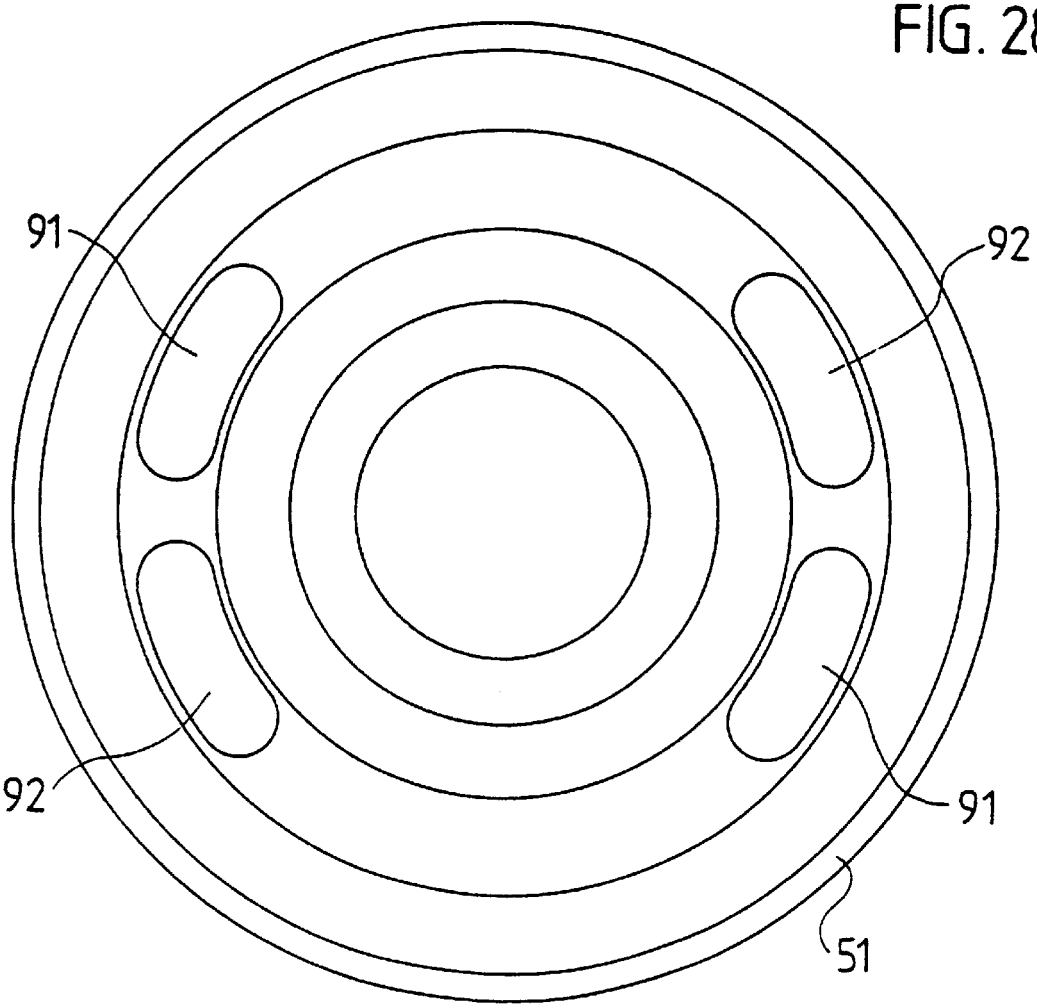

AXIAL PISTON ROTARY ENGINE

TECHNICAL FIELD OF THE INVENTION

THIS INVENTION relates to rotary internal combustion engines, and more particularly it relates to an engine having different basic principles from the many rotary engines currently being developed.

BACKGROUND ART

In recent years, the most popular types of rotary engines which have been devised utilise a rotating block having radially disposed cylinders with pistons therein having their outer ends movable relative to guide tracks as shown, for example, in German specification No. 619,955 of Bodda, as well as many United States patents such as U.S. Pat. Nos. 4,003,351, 4,023,536 and 4,974,553. Quite sophisticated design details have been associated with these several proposals which make a useful contribution to the field of such types of rotary engines, including suitable ancillary mechanisms essential to their operation, such as means permitting periodic introduction of air and fuel into the combustion chamber for each cylinder and piston; means for causing combustion of a compressed mixture of air and fuel within the respective combustion chamber, and means permitting periodic exhaust of products of combustion of air and fuel.

We have recently developed a radial-piston type rotary engine of the aforementioned general type, as disclosed in our Australian Provisional Patent Application No. PN6474 which we believe exhibits a number of advantages over current proposals in relation to rotary engines having radial pistons.

Nevertheless, our developments in this currently-popular field of engines has caused us to review another type of rotary engine in which the cylinders are arranged in equally-spaced relationship around a central axis, the pistons being parallel to one another and said axis, drive means being provided for the pistons so that they co-operate with cam track means which will cause a rotor assembly to rotate to drive an output shaft. Examples of this basic type of parallel-cylinders rotary engine are to be found in United States patent specifications such as U.S. Pat. Nos. 4,287,858 of Anzalone, 4,250,283 of Chang and 4,022,167 of Kristiansen. However, all of these are of very cumbersome construction, the pistons requiring elaborate mounting and guiding so that the assemblies are unduly long. This applies particularly where the co-acting cam arrangements are disposed medially of the apparatus as in U.S. Pat. No. 4,287,858. Where separate pistons are employed, each mounted independently, all the usual piston skirts and axial guidance means must be provided so that the assemblies are heavy, costly and cumbersome. It will be noted that disclosures can be derived from the prior published specifications so as to make it unnecessary for our detailing at length the corresponding arrangements in our present proposal where these are similarly required in our ancillary mechanisms, permitting this specification to concentrate on the broad principles, differences and aspects.

The present invention has been devised with the aim of overcoming or alleviating the problems presently encountered with the known types of engines having their piston axes parallel to one another and arranged around a central axis, and it has as its principal object to provide novel drive means which will ensure that maximum efficiency may be obtained using cylinders and pistons of relatively short length.

Another object of the invention is to provide such an engine which will be light in weight, small in size, and consist of a minimum number of parts particularly in respect of the wearing parts.

Yet another object of the invention is to provide such an engine capable of running on petrol or any combustible fuel, but which is particularly suited to slow burning fuels such as diesel.

Yet another object of the invention is to provide a rotary invention of the aforementioned type whereby all fuel will be burned for maximum economy and reduced exhaust emissions. Other objects and advantages of the invention will be hereinafter apparent.

DISCLOSURE OF THE INVENTION

With the foregoing and other objects in view, the invention resides broadly, according to one aspect, in a rotary internal combustion engine of the type having pistons mounted for reciprocatory movement in respective cylinders which are arranged in equally-spaced relationship around a longitudinal axis of rotation, said axis being the axis of rotation of an output shaft passing rotatably and sealably through apertures of respective first and second end plates of a housing within which the pistons and cylinders move as part of a rotatable rotor assembly secured to said output shaft, while the pistons are simultaneously movable reciprocably in the cylinders, cam follower means being associated with each piston and adapted to coact with undulating cam track means around the housing, means being provided for conveying combustible fuel to, and for conveying exhaust gases from the operative ends of the bores of the cylinders whereby cyclical combustion of said fuel in said bores imparts reciprocation to the pistons with resultant thrust against the cam track means so as to cause rotation of the rotor assembly and output shaft; characterized in that the pistons include two sets thereof each having at least two pistons, the pistons of each set being at opposite sides of the axis of rotation of the rotor assembly and output shaft and interconnected by piston-connection means so that the pistons of each set move in unison, the parts being so made and arranged that the piston cam follower means coact with the cam track means in a manner ensuring that movement of either set of pistons in their cylinders is in the direction opposite to the direction of movement of the other set of pistons.

The pistons of each set thereof preferably have their piston-connection means in the form of a piston mounting plate having an aperture through which the output shaft extends, means being provided whereby the piston mounting plate may be drivably connected to the output shaft as part of the rotor assembly while being permitted guided sliding movement in the direction along said axis and output shaft to permit movement of its pistons in their cylinders.

In certain embodiments, the means whereby each piston mounting plate may be drivably connected to the output shaft comprises longitudinal spline ribs along the output shaft engaging slidably but rotatably in corresponding peripheral grooves about the said mounting plate aperture. In other embodiments, the means whereby each piston mounting plate may be drivably connected to the output shaft comprises guide apertures in the mounting plate towards opposite ends thereof and adapted to receive slidably the free ends of guide pins disposed parallel to the output shaft axis and having their other ends rigidly connected to drive plate means forming part of the rotor assembly and secured to the output shaft.

The engine may have any desired number of cylinders, but typically each mounting plate has three, four, or more arm sections extending radially relative to the output shaft and each having a piston mounted rigidly at its outer end, the pistons of each set being equally spaced and with spaces between adjacent pistons so that those of one set engage in their respective spaced cylinders, while the pistons of the other set engage in their respective cylinders which are each midway between adjacent cylinders of the first set, all cylinders having their fuel-receiving operative ends in longitudinal register relative to the said axis of rotation. In such a construction preferably each cylinder comprises a cylinder member secured detachably in an engine block portion of the rotor assembly, the output shaft having affixing means whereby it may be pinned or otherwise secured to said engine block portion of the rotor assembly.

So far as the cam arrangements are concerned, it is preferred that the cam follower means includes a roller mounted on its respective piston for rotation at the non-operative end of its cylinder bore about an axis at right angles to said output shaft axis, the rollers of all pistons being at the same distance from said output shaft axis and the cam track means being an annulus mounted on the inner face of said first end plate of the housing, the latter being the drive end of the engine at which the output shaft extends to permit its use as a drive shaft.

In a preferred embodiment, the first end plate has external openings therein provided with fixed port means adapted to register with corresponding movable ports on the rotor assembly for admitting fuel to the operative ends of the cylinder bores, the first end plate being at the induction and exhaust end of the engine and constituting a mounting for fuel injector means, spark plug or equivalent means and exhaust outlet means.

Preferably also, the first end plate has a pair of diametrally opposed spark plugs constituting said spark plug or equivalent means, a pair of diametrally opposed fuel injector assemblies constituting said fuel injector means, and a pair of diametrally opposed exhaust outlets constituting said exhaust outlet means, all said pairs being arranged at spaced intervals to coact with cylinder ports to permit successive intake, compression, power and exhaust functions of the pistons.

Suitably for cooling of the engine, the end of the output shaft at the induction and exhaust end of the engine is hollowed to provide coolant entry means, said shaft being rigid with the rotor assembly and having inlet passages from its hollow interior to the external periphery of each cylinder for cooling same, the rotor assembly having coolant collector means provided with sealing means whereby used coolant may be returned from the rotor assembly to the second end plate which is provided with coolant outlet means therefor.

In some embodiments, each cylinder is adapted to receive fuel through an inlet port adapted to rotate with the rotor assembly into register with a respective port in the fixed housing, with face-to-face sliding contact in a plane perpendicular to the axis of the output shaft, sealing between the faces being effected by an annular sealing ring adapted to compress a resilient heat-resistant ring between its lower face and a recess of the cylinder port opening at a distance from the inner surface of the port substantially equal to the width of an upper recessed face of the sealing ring to enable balancing forces to be applied thereto by pressures in the cylinder port. Alternatively, sealing between the faces may be effected by an annular sealing ring having an inner recess containing a tiltable spring steel or the like ring adapted under pressure to seal against the recess edge and maximise the sealing effect of said sealing ring.

The invention also embraces constructions in which the housing has first and second cam track means associated with the first and second end plates respectively, and the rotor assembly has first cam follower means co-acting with the first end plate in relation to reciprocatory motion of the pistons and has second cam follower means co-acting with the second end plate in relation to reciprocatory motion of the cylinders. In such construction, the first and second cam follower means are both suitably constituted by rollers rotatable about axes at right angles to the axis of rotation of the output shaft.

In most embodiments the housing suitably includes a substantially cylindrical casing body connected sealably to and between the two housing end plates which are substantially circular when viewed in the direction along the axis of rotation. Other features of the invention will be hereinafter apparent from the ensuing drawings and descriptions.

BRIEF DESCRIPTION OF THE DRAWINGS

In order that the invention may be more readily understood and put into practical effect, reference will now be made to the accompanying drawings, wherein:

FIG. 3 illustrates design details where a splined centre or output shaft is employed, shown relative to the bearings and end plate;

FIG. 4 illustrates schematically the operation of the strokes, coupled with rotation, the latter being clockwise when viewed down the block as shown;

FIG. 5 shows the comparative wave forms for the driving force on torque comparisons between a crank driven engine according to the prior art, and the cam driven arrangements of our invention, for the same bore and stroke;

FIGS. 27 and 28 show in cross-section and axial view respectively the induction/exhaust end plate of the engine in FIGS. 1 to 25.

BEST MODES FOR CARRYING OUT THE INVENTION

Figure 1:
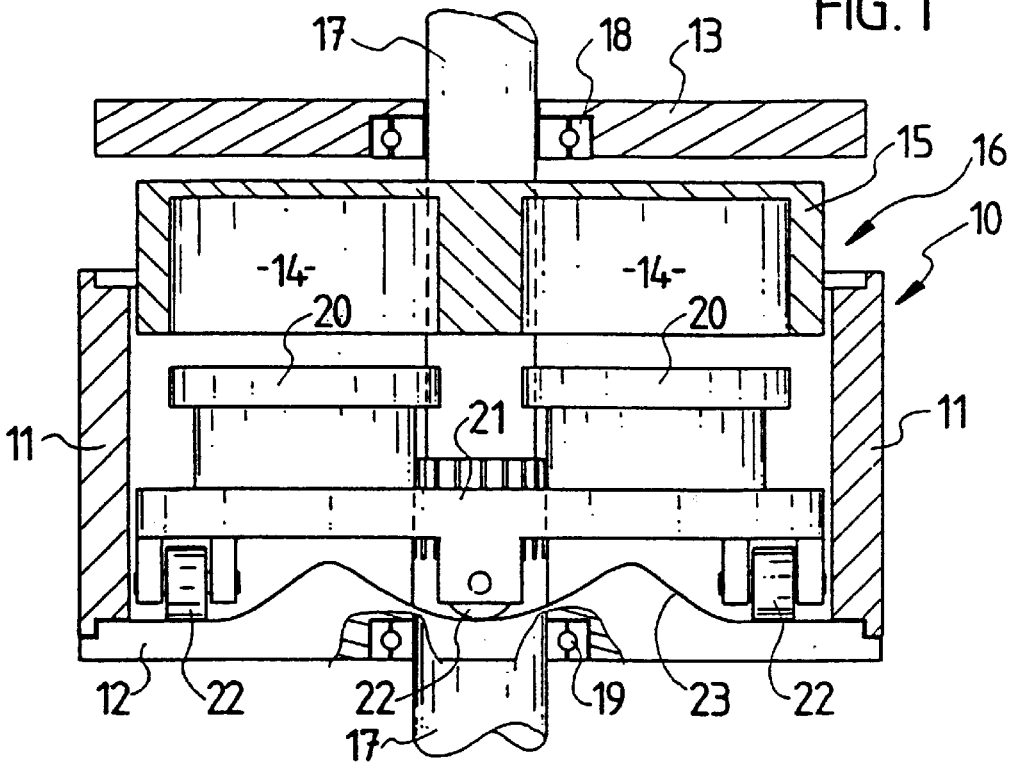
FIG. 1 shows diagrammatically or schematically in cross-section or elevation the basic components (in separated relationship) of one form of engine according to the invention, with parts omitted for simplification purposes.

While FIGS. 1 to 10 are in simple form to enable the broad principles to be easily understood, it will be appreciated that they are mainly schematic and with many components omitted, whereas the later descriptions with reference to FIGS. 11 to 26 embrace more specific constructions. As shown initially in FIG. 1, the engine includes a housing indicated generally at 10 and having a cylindrical casing portion 11 sealably connected between circular end plates comprising a first or drive end plate 12 and a second or induction/exhaust end plate 13, the plate 13 having entry ports (not shown) for fuel entry and exhaust, as well as suitable spark plug or glow plug provisions. The design lends itself to coolant being supplied to the entire central system around cylinders indicated at 14 and then exiting centrifugally at the periphery of the housing 10. This drawing shows the two cylinders 14 on a cylinder block 15 of a rotor assembly 16 rotatable in the housing 10 by virtue of its operative connection to an output shaft 17 journalled in bearings 18 of the second end plate 13 and bearings 19 of the first end plate 12.

It will be seen that the cylinders 14 can receive pistons 20 movable in unison by virtue of their connection by a piston mounting plate 21 carrying regularly spaced roller bearings or rollers 22 adapted to engage low and high cam sections of an undulating cam track 23 secured to or forming part of the first or drive end plate 12. In this embodiment the output shaft 17 is splined to engage external grooves about an opening in the mounting plate 21 through which the shaft 17 passes, so that the plate 21 can be driven thereby and also slide axially along the shaft 17.

FIG. 1 thus illustrates the basic operation for the system in which the pistons 20 can move parallel to the axis of the output shaft 17, and after the cam track 23 thrusts the pistons 20 in the compression stroke, firing will drive the pistons 20 down again while being retained in their cylinders 14, the rollers 22 keeping contact with the face of the undulating cam track 23 at all times, other pistons also being carried down with them for their intake stroke. The cam track 23 then thrusts the pistons back again into their cylinders, two on exhaust stroke and two on compression stroke, this procedure being repeated so that the pistons and cylinders are rotated in the pre-determined direction to rotate the output shaft 17 for power supply. The second pair of pistons (not shown) to complete the four-cylinder arrangements of FIG. 1 are similarly connected by a mounting plate (not shown) for movement in unison, the four cylinders being equally spaced around the axis of rotation.

Figure 2:
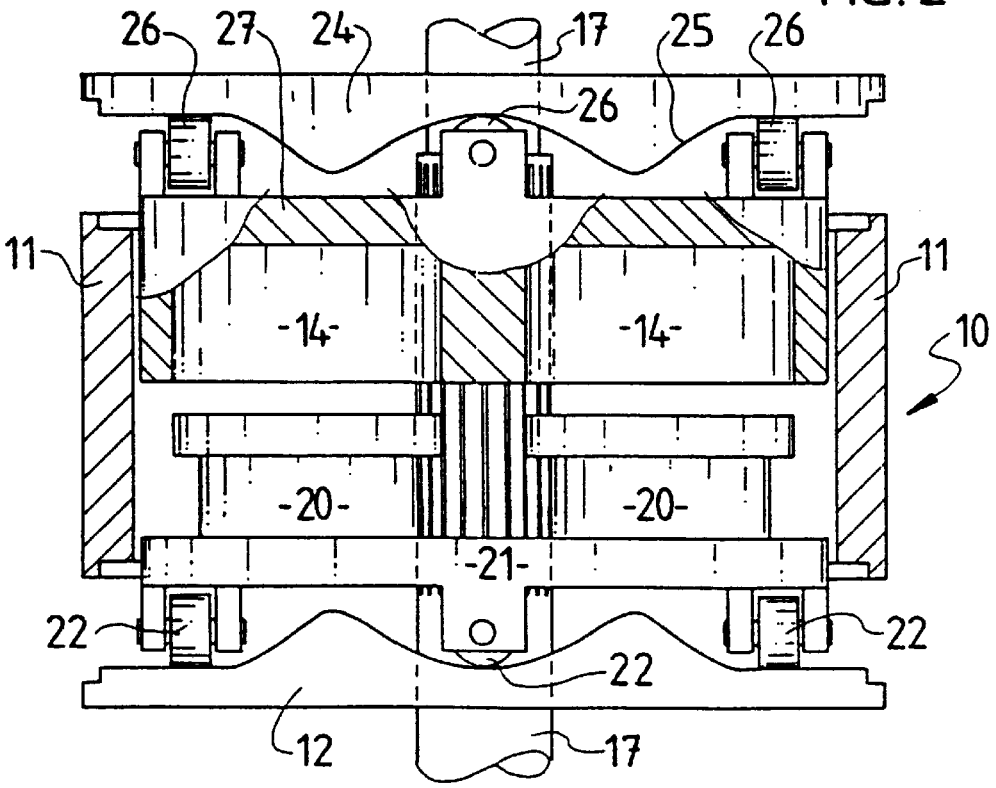
FIG. 2 is a similar view to FIG. 1 but showing a modified engine having spaced and opposed cam track means at each end instead of at one end only.
Figure 6:
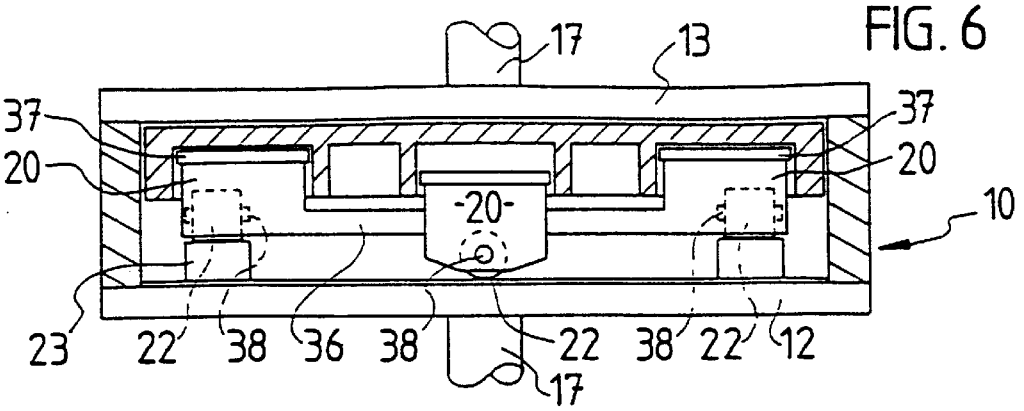
FIG. 6 is a cross section similar to FIG. 1 but showing in more detail the piston mounting plates, the pistons on the lower plate compressing and exhausting, the pistons on the upper plate having just completed power and intake strokes, it being understood that the top end plate has ports (not shown in this FIG. or in FIGS. 1 and 2) timed by a rotary valve system for fuel, air, exhaust and ignition as apparent from FIG. 5.
Figure 7:
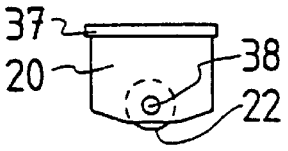
FIGS. 7, 8 and 9 are a piston end view and side view of the lower piston plate, and side view of the upper piston plate, respectively.
Figure 8:
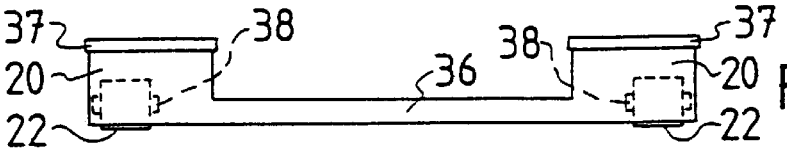
Figure 9:
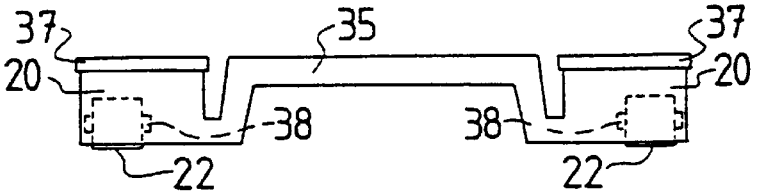
Figure 10:
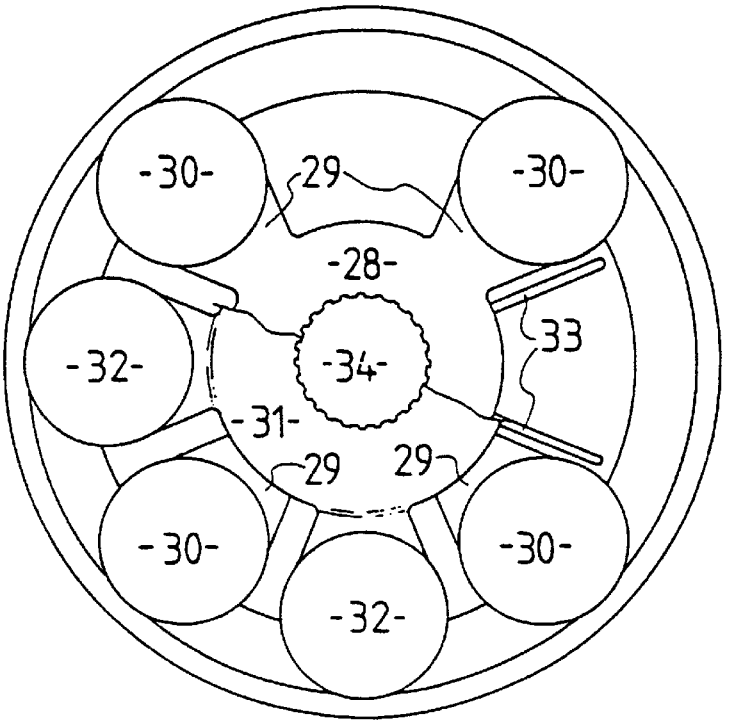
FIG. 10 is a view of a projected alternative design according to the invention, partly broken away, illustrating the provision of upper and lower pistons, each set of four pistons being on their own piston mounting plate, the lower pistons being movable upwards as the upper pistons move down and so forth, the centre shaft being splined.

FIG. 2 shows a modified arrangement in respect of the components just described except that a cam-equipped end plate 24 replaces the end plate 13 of FIG. 1, the cam track 25 engaging with rollers 26 on the cylinder-carrying block 27 which is thus different from the block 15 of FIG. 1. Naturally in this embodiment the cylinder-carrying block 27 is also slidable on a splined section of the output shaft to permit the cam actions against both sets of rollers 22 and 26.

The advantages of this general system having parallel cylinders 14 are that it requires no centrifugal force to return the pistons, with no springs being required, and with no double tracking needed to thrust the rollers in and out, as compared with the prior art. The cam track thrusts all the pistons together, two on compression which keeps the rollers in positive contact with the track, and the other two will be exhausting at this time (though it will be clear that the invention is not confined to using four pistons only) with relative movement axially between piston and cylinder upon firing by glow plug or spark plug means through a port which has lined up with the cylinder at that stage. Two pistons move in unison on the power stroke and the other two in unison on the intake stroke for the reason that the driving force on the cam-like surfaces creates a rotating force so that the two pistons which have just fired return on the exhaust stroke, the other two being on the compression stroke. The process repeats so that we then have four pistons travelling back and forth. To balance this the cylinders also travel back and forth opposed to the pistons.

In the FIG. 2 embodiment by providing a cam system at each end of the housing, the torque and stroke will be doubled. However, the porting would suitably be around the circumference of the housing to enter the rotating engine block at the sides of the housing, cooling being achieved by oil or other suitable coolant. It will be apparent that the connected pistons will ensure that one set moves in one direction, while another set moves in the opposite direction, but of course both rotating in the same direction.

While many variations are possible in achieving the above results, the principal feature is that the pistons of each set can be made integrally with their mounting plate and with no moving parts. In the simplest practical embodiment, we could suitably have the firing of four pistons each four inches in diameter and with a stroke of say 1.3 inches. Firing twice every revolution equals eight firings per revolution at a leverage of three times that of a 350-CI-V8 engine. This gives us a comparable torque of 2–1 i.e., in one revolution we achieve what it takes two revolutions to achieve in a normal V-8 engine. This is also achieved with one-quarter the rpm speed, our engine's 1000 rpm being equal to 4000 rpm for the V-8 engine. This means that we have twice the torque of the 350 V-8, and also our fuel usage can be calculated as one-third that of the comparable unit simply due to the fact that our intake need only be one-third to achieve the same results.

The invention also has the advantage of torque throughout the stroke, and the number of parts is reduced since there are no conrods, no gudgeon pins, no big end bearings, no levers, no push rods, no lifters, no gears and no crank shaft. There are two main bearings in the end plates, and there are typically four cam roller bearings for each piston plate as apparent from FIGS. 1 and 2, but the number will vary according to the number of high and low cam surfaces or cam members and the resultant number of firings per revolution. These bearings and rollers provide the total number of support parts for the moving components. It will be apparent that no oil pressure is required, and no coolant pump is needed as the unit can centrifugally induce coolant. As compared with current vacuum problems in engines, ours is designed for constant partial bleed whereby spaces are intentionally filled with exhaust gases to dispense with the undesired sucking in of fuel or air. By comparison with a 350 V-8 engine, it is estimated that outside dimensions for our engine may if desired be in the order of 12 inches diameter by six inches axial dimension. It is expected that the preferred forms of engine will employ eight cylinders as two sets each of four cylinders and achieving excellent results even on a small unit as shown diagrammatically in FIG. 10 where the piston plate shown as the "lower" plate 28 has four radial arms 29 each mounting a piston 30, the "upper" plate 31 being cut-away so that only two pistons 32 thereof are shown, with two gaps 33 shown between adjacent lower pistons on one side. The centre shaft 34 in FIG. 10 will be of the splined variety to permit sliding of the plates 28 and 31 therealong.

The basic requirements for the pistons 20 are shown in FIGS. 6 to 9 which show details of upper piston plates 35 and lower plates 36, each piston 20 having a cylindrical operative end 37 to be fitted with piston rings (not shown) while its inoperative end has a roller pin 38 on an axis at right angles to the output shaft axis, as well as a roller 22. The designs allow for easy manipulation of the engine capacity while running, depending upon the load incurred at any one time, such as while accelerating or cruising. Also piston dwell can be set at any duration and can be altered according to the engine rpm while running, as can all porting for intake and related functions.

Another advantage is that the pistons do not need support in their cylinders as at no time does any part of the piston (other than its rings) contact the cylinder wall, and hence the cylinders can be made to minimum length, requiring only enough length for the piston stroke and sealing ring and gland space requirements. As each piston is integral with a mounting plate, with no skirt for support being required, it follows that it needs no gudgeon, or rod, or lever or the like of any kind. Also because each piston is integral with its mounting plate and other pistons of the same set, the pistons move in the cylinders along with all other pistons of the same plate, and it follows that there is no need to provide systems to hold the piston rollers against the cam face while the engine runs, such as providing rollers under a cam track to guide the pistons out of the cylinders on the intake stroke. When two pistons of one set fire to cause them to move down the cylinder bores, two more pistons on the same plate will naturally also move down the bore, with this however being their intake stroke, and so forth.

The preferred practical embodiment of the invention shown in FIGS. 11 to 26 has been designed to embrace all the advantages as aforementioned, embodying refinements which are even optional in some instances, such as the use of spring means to assist initial movement of pistons away from the operative ends of the cylinders for enhanced start-up function, not being required after the engine is running. As shown in these drawings, the housing 50 has a circular induction/exhaust end plate 51 secured against a cylindrical casing 52 which is connected by screws 53 to a drive end plate 54. There is a central rotatable output shaft 55 having a hollow tubular end 56 adapted to receive coolant, the shaft 55 having an intermediate securing collar plate 57 and a reduced diameter solid section 58 at its other or drive end, the extremity being of further reduced diameter and threaded at 59 for lock nut engagement.

The end 59 of the shaft 55 is received and locked in a clamping tube 60 by said lock nut engagement, said tube 60 being rotatable in a bearing 61 in an opening 62 of the drive end plate 54, with an oil seal provided at 63, the inner end of the clamping tube 60 being integral with a drive plate 64 rotatable in the space within an annular undulating cam track 65 secured by screws 47 to the inner face of the end plate 54. Extending inwards from the drive plate 64 are linear drive pins 49 adapted to engage slidably in linear bushes 48 in apertures 66 of the lower piston plate 67 so that the latter is constrained to rotate with the drive plate 64 while being axially slidable relative thereto. Also extending inwards from the drive plate 64 are spring guide rods 68 having at their upper ends compression springs 46 acting to force the piston plate 67 away from the engine block 77 to assist initial start-up of the engine.

Figure 11:
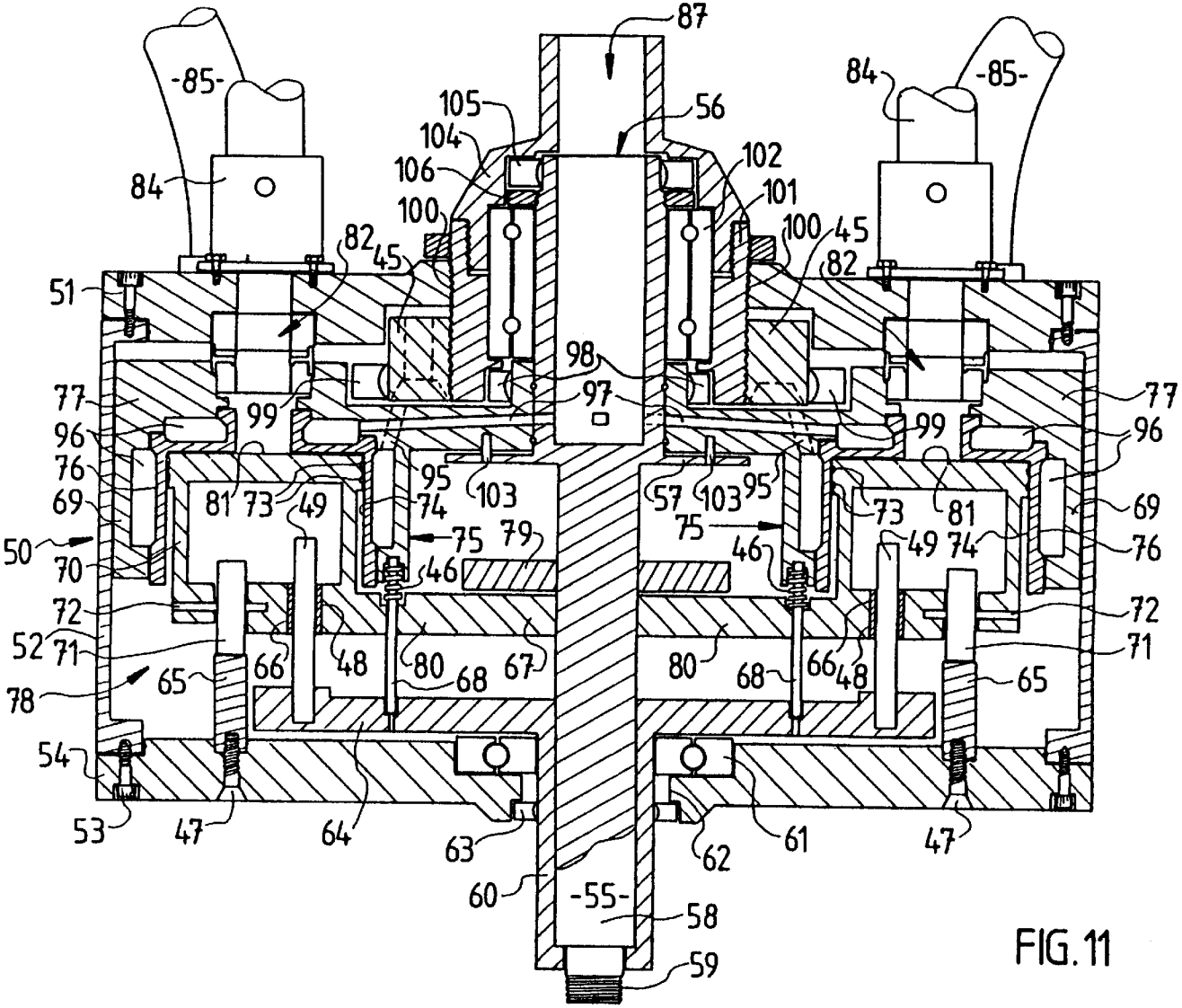
FIG. 11 is a cross-sectional view through a preferred practical form of engine according to the invention.

The annular cam track 65 undulates between high and low sections which are of the same height at opposite sides where the pistons 70 are mounted rigidly at equal distances from the cam track portions with which their cam rollers 71 engage, each cam roller being mounted rotatably on a cam pin 72 having its axis at right angles to the axis of the output shaft 55, the operative ends of the pistons 70 having piston rings 73 engaging in the bores 74 of the respective cylinders 75 defined by removable cylinder sleeves 76 secured in shirt portions 69 of the engine block 77 which is part of the general rotor assembly 78 rotatable with the drive shaft or output shaft 55. There is also an upper piston plate 79 movable reciprocably along the output shaft 55 in the space towards the inlet side of the lower piston plate 67 as shown in FIG. 11, the piston arrangements being the same for both plates 67 and 79, each having four pistons 70 equally spaced at the ends of radial arms 80, the pistons of one set alternating with the pistons of the other set in the continuous ring of cylinders 75. Each piston has a crown 81 sealing its operative end and adapted to be subjected to firing gases in operation.

Figure 12:
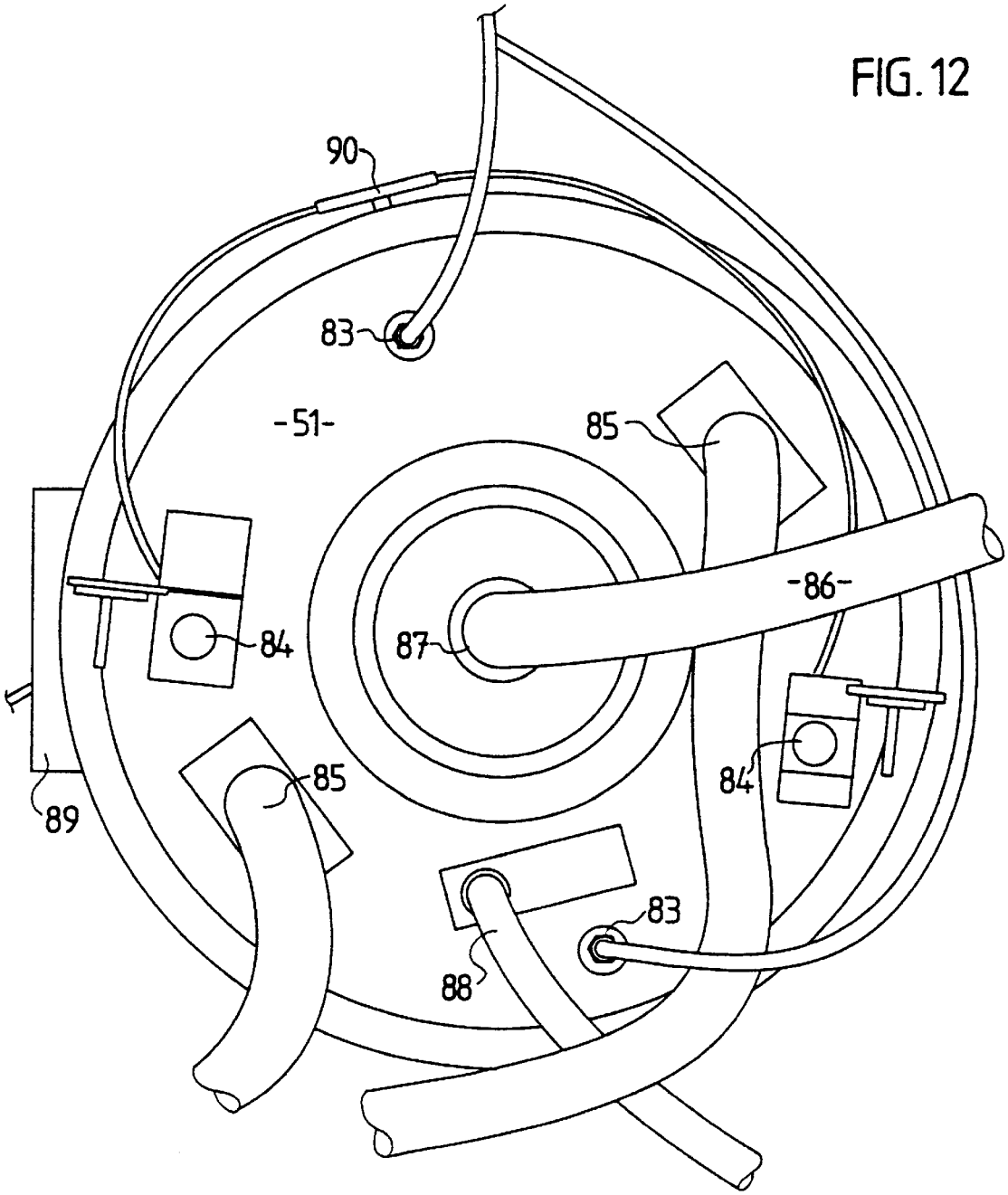
FIG. 12 shows the induction and exhaust end of the motor viewed in the direction along the axis of rotation.
Figure 13:
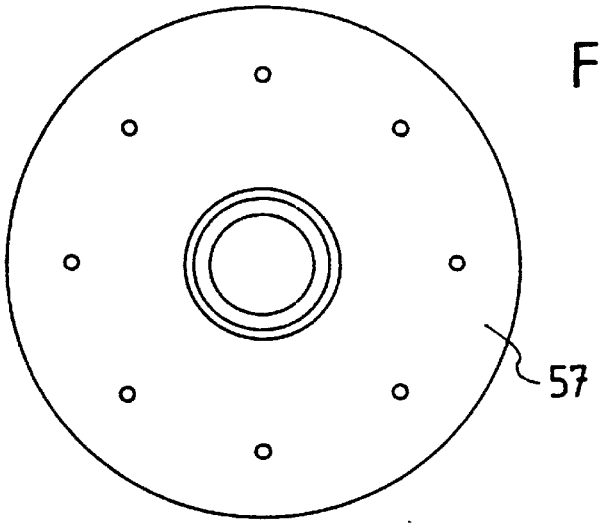
FIGS. 13 and 14 show in axial view and in cross-section respectively, the output shaft of the engine.
Figure 14:
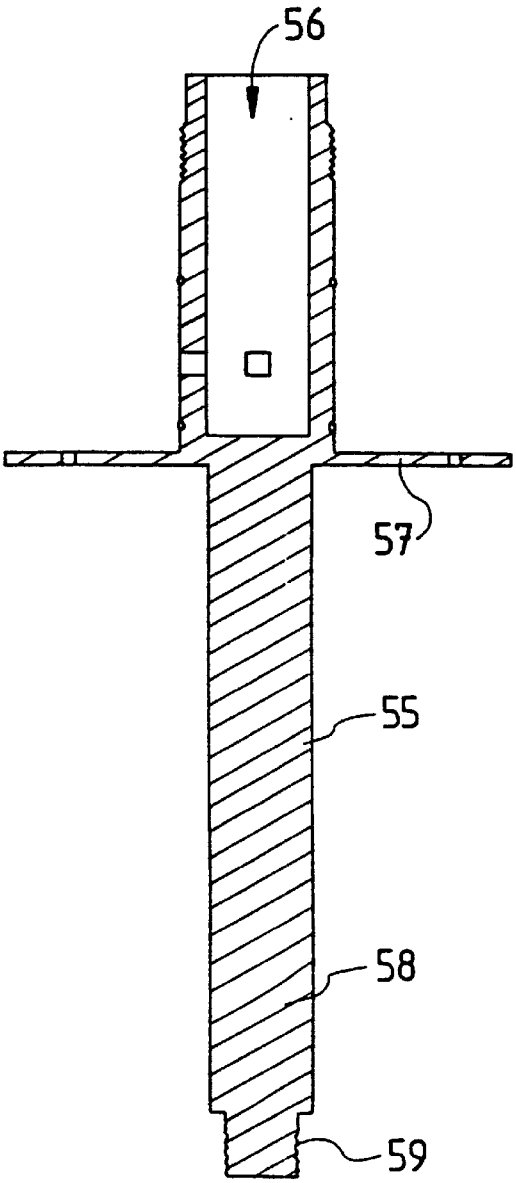
Figure 15:
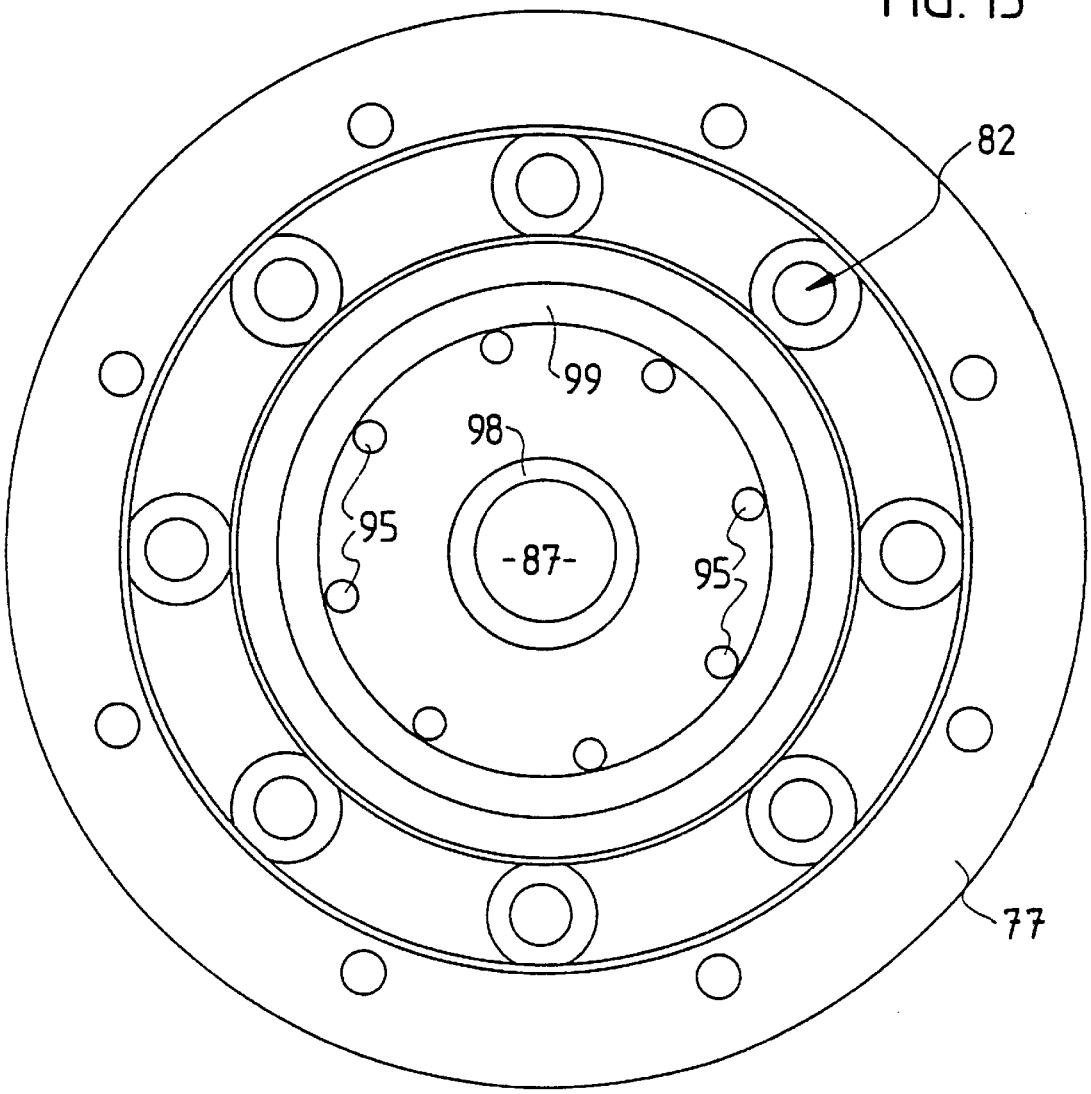
FIG. 15 shows in axial view the engine block which has the pistons on the opposite side (not shown) thereof.
Figure 16:
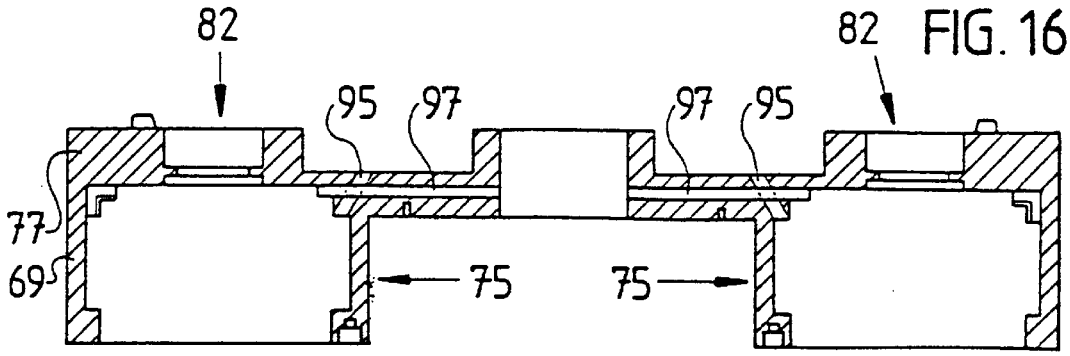
FIG. 16 shows the cylinder mounting plate in cross-section.
Figure 17:
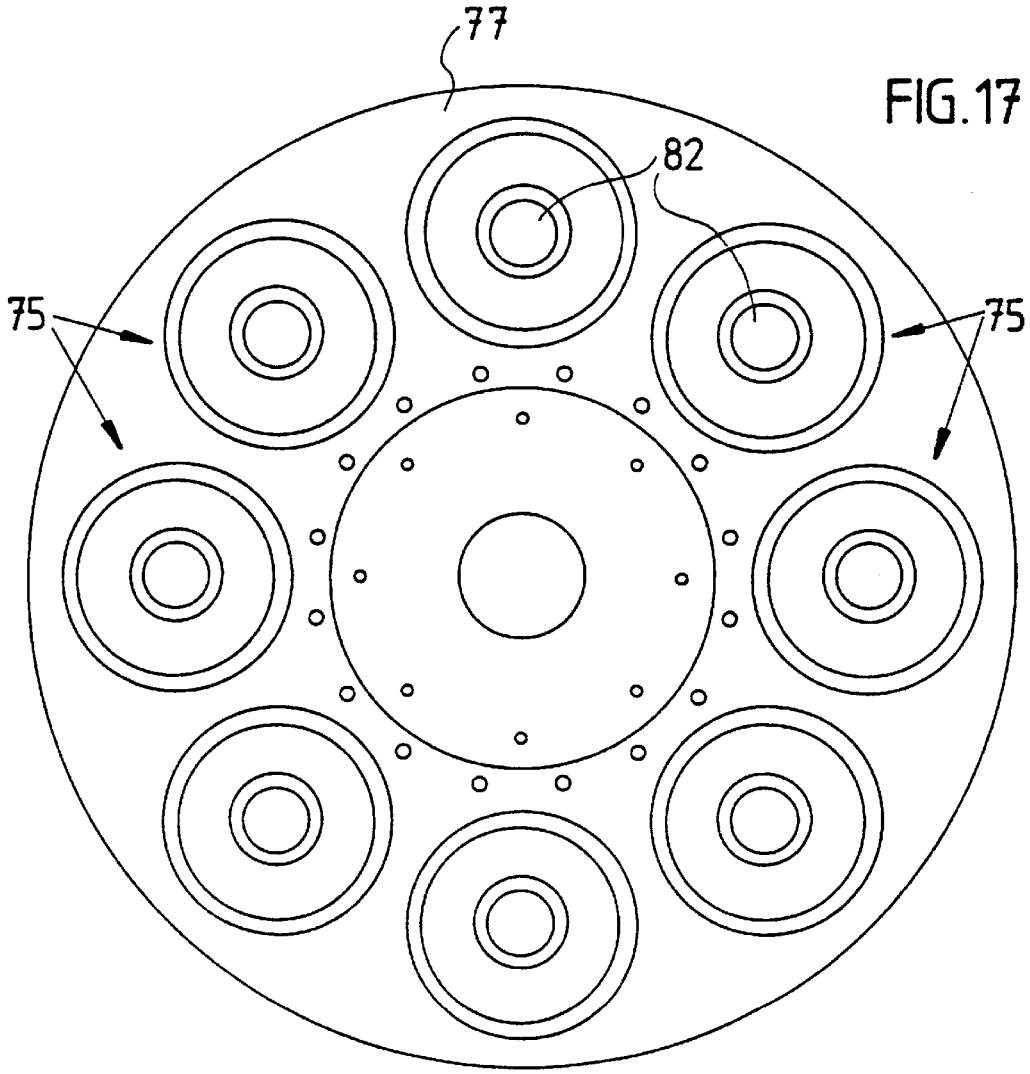
FIG. 17 is an axial view from beneath of the plate illustrated in FIG. 16.
Figure 18:
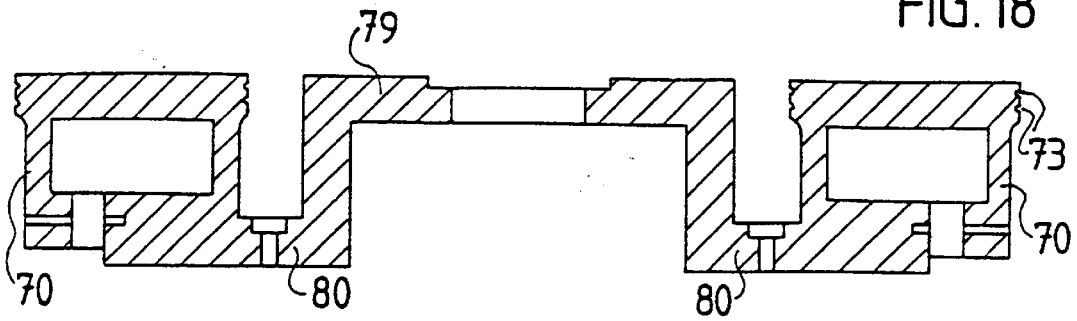
FIGS. 18 and 19 show the upper piston plate in cross-section and axial view respectively.
Figure 19:
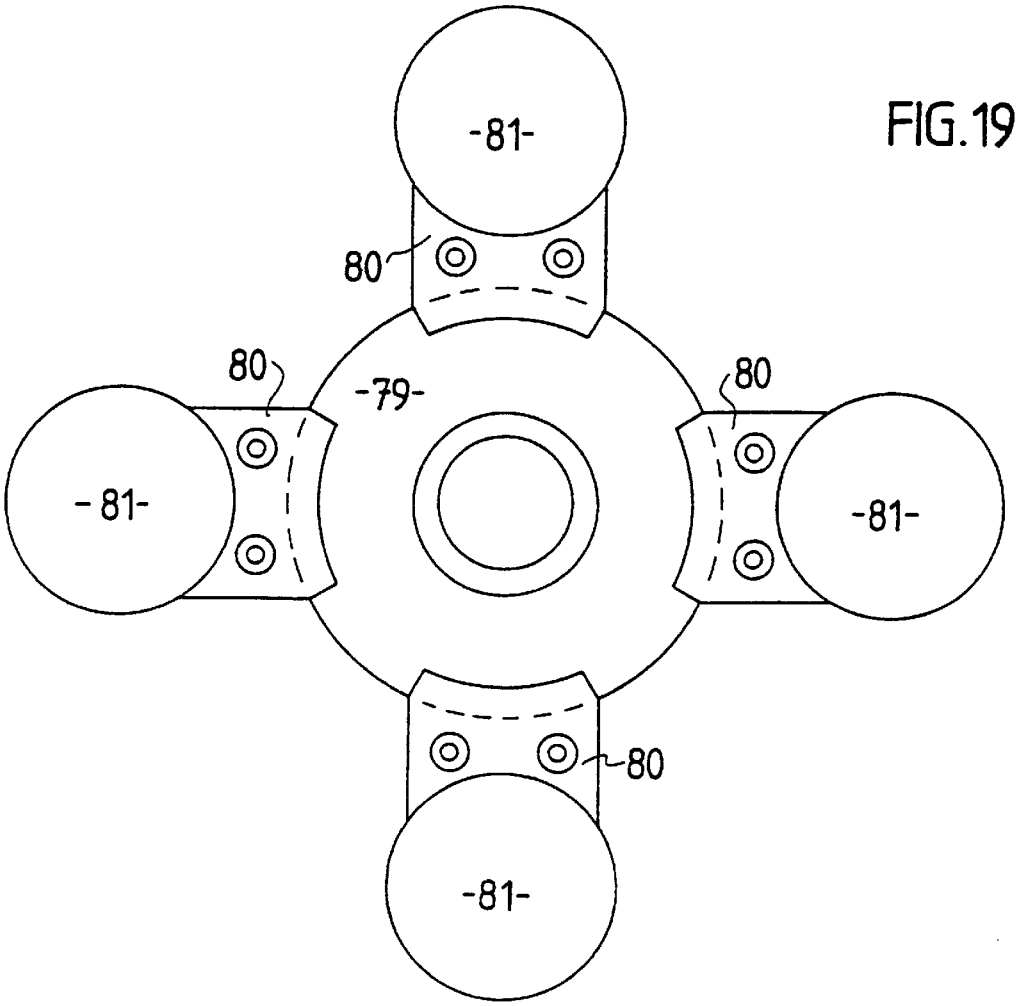
Figure 20:
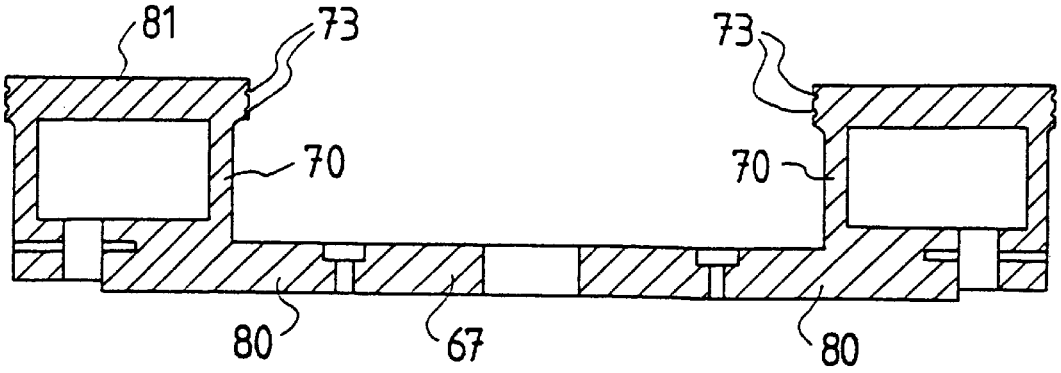
FIG. 20 shows the lower piston plate in cross-section.
Figure 21:
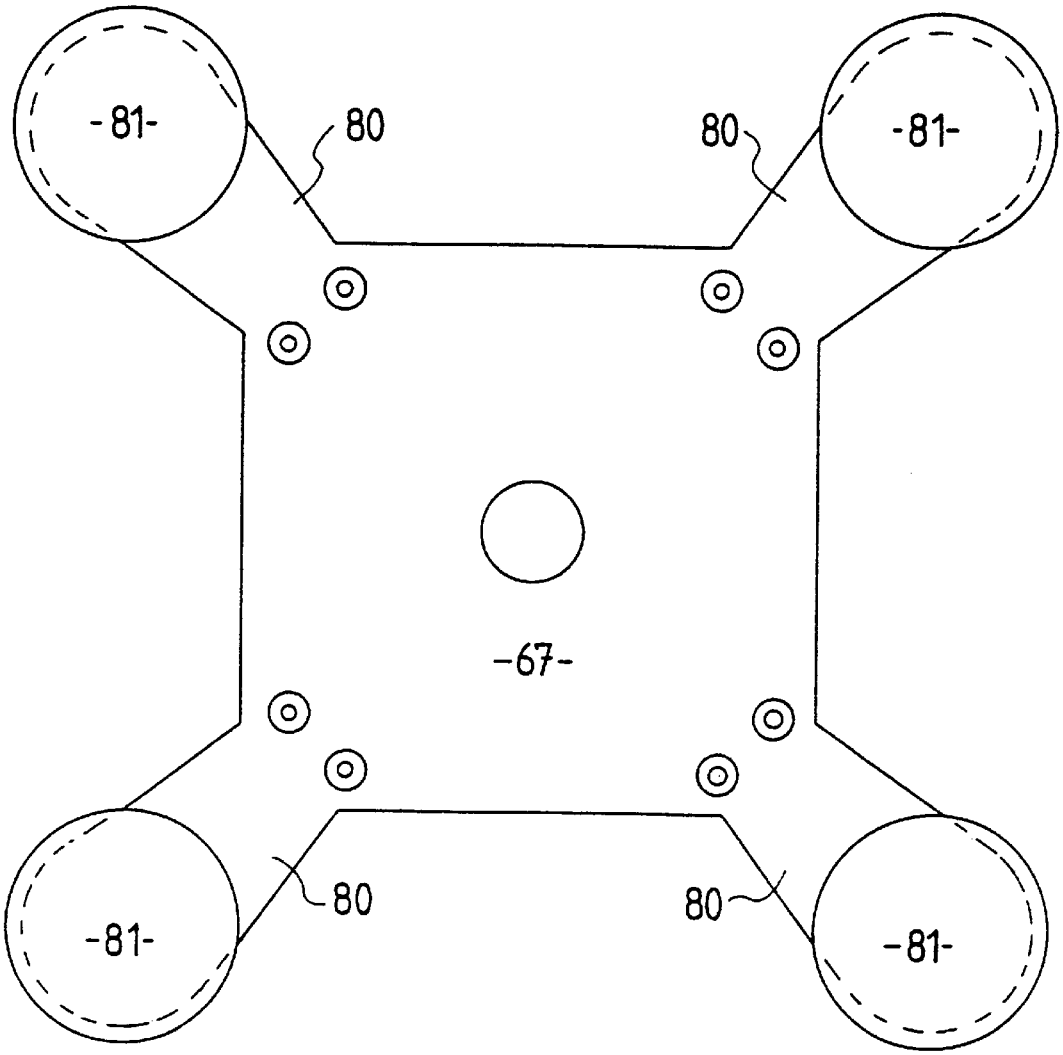
FIG. 21 corresponds to FIG. 20 in axial view.
Figure 22:
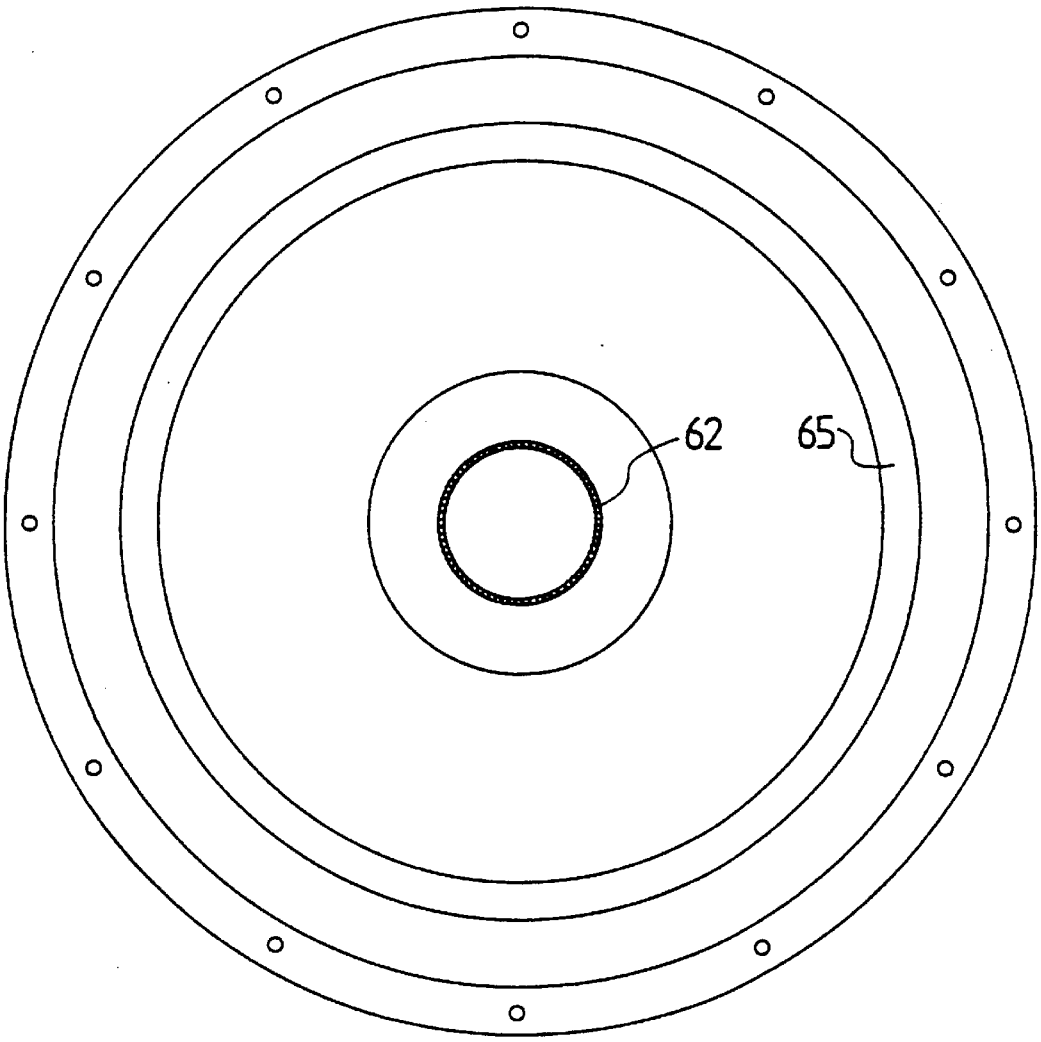
FIGS. 22 and 23 are axial view and sectional view respectively of the end plate at the drive end of the engine.
Figure 23:
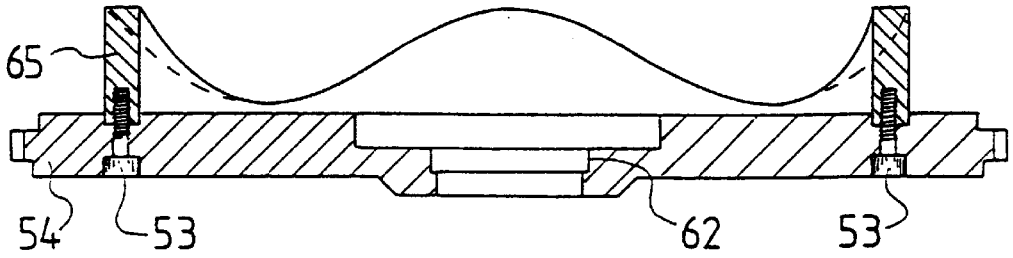

The exhaust/induction end plate 51 ("said top plate") provides a mounting for the external items shown in FIG. 12, arranged in a circle of the cylinder openings or ports 82 (see FIG. 11 and others) and including opposed spark plugs 83 having leads to coils as shown; opposed fuel injectors 84, opposed exhaust outlets and lines 85; a supply line 86 to the coolant inlet 87 of the output shaft 55; and a coolant outlet and line 88, there being shown at 89 the pick up for electronic ignition and at 90 the vacuum hose to the fuel injector via the PCV (Positive Crankcase Ventilation) valve. FIG. 28 shows the intake and exhaust ports 91 and 92 of the induction end plate 51 while FIG. 27 shows the hard seal facing 93 thereof as well as a recess portion 94 for a coolant collector 45 retained adjacent the rotatable engine block 77 and having openings to receive used coolant via passages 95 communicating with the chambers 96 for circulating coolant around the cylinder sleeves 76, the coolant being supplied to said chambers 96 via radial passages 97 through the engine block 77 from the hollow end part 56 of the output shaft 55. Two oil seals are shown at 98 and 99 to prevent coolant reaching the cylinder ports 82.

Said top plate 79 has a tapped central aperture 100 into which is screwed a threaded block clearance adjustment sleeve 101 containing the thrust bearing 102 for the output shaft 55 which has its securing collar 57 secured by pins 103 to the engine block 77. A top cap member 104 is screwed to the adjustment sleeve 101 to enclose an oil seal 105 and locknut 106 encircling the output shaft.

Figure 24:
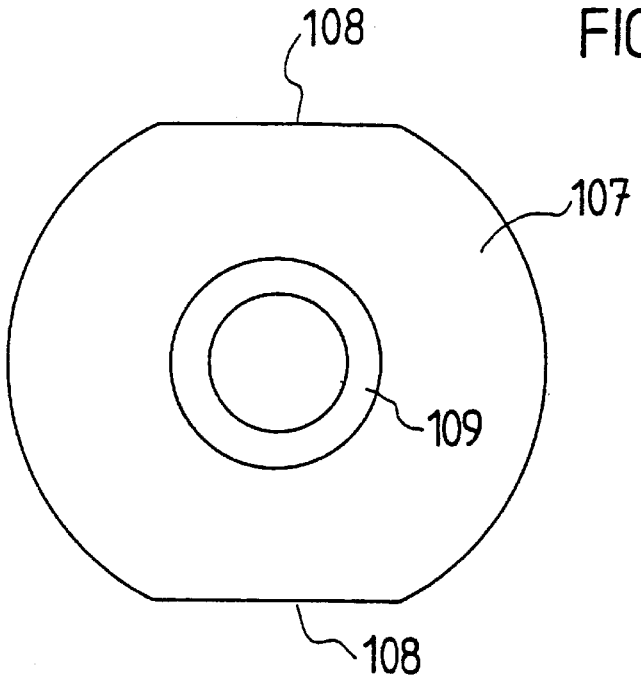
FIG. 24 shows in axial view a port-sealing member as included in FIG. 11.
Figure 25:
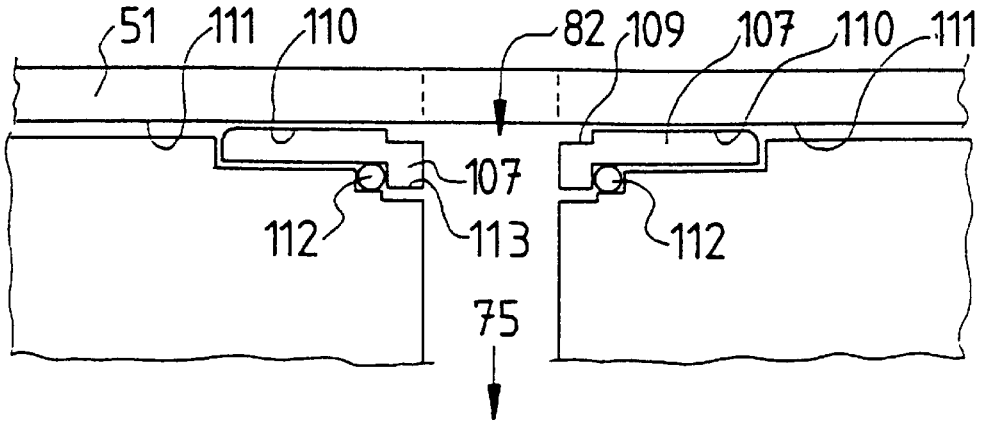
FIG. 25 is an enlarged view of the installation of the sealing member as shown in FIG. 11.

The manner in which sealing is maintained at the cylinder ports 82 as the engine block rotates will be clear from the drawings, the items in FIG. 11 being shown to enlarged scale in FIGS. 24 and 25, each port 82 leading to a cylinder 75 having a seal annulus 107 provided with flats 108 to prevent rotation, with a pressure recess at 109 and top sealing face 110 to wipe against the fixed face 111 of the top plate 51. The edge of the port 82 is recessed so that a VITON O-ring 112 is compressed by an inner flange of the sealing annulus 107 in such manner that the pressure recess face 109 is equalised by an equal lower face 113. This seal is designed to offer minimum pressure against the sealing face no matter what gas pressure is present, allowing for a long life with minimum friction and heat.

Figure 26:
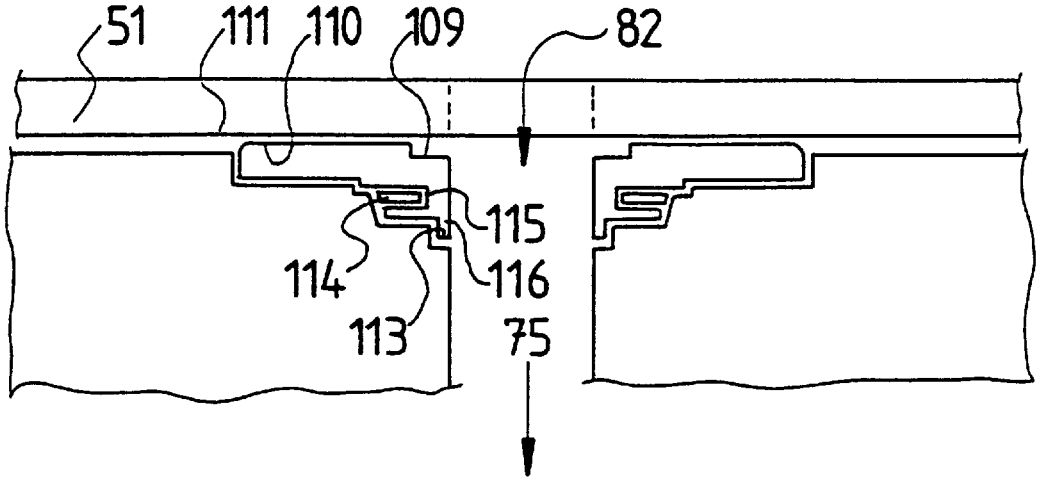
FIG. 26 is a view corresponding to FIG. 25 but showing an alternative form of sealing arrangement.

An alternative sealing arrangement is shown in FIG. 26 where there is a tiltable ring 114 held in a recess 115 and movable outwards against an angular edge adjacent the port, the thrust ring acting as a seal to prevent gases leaking past and being made to desired inclination or angle to ensure a non-return action. The other aspects of the sealing annulus 116 for this embodiment are similar to those described for the annulus 107 of FIGS. 24 and 25.

The lock nut arrangements associated with the top cap member 104 will be found very effective in providing adjustment for the seal clearances to meet requirements, but as previously mentioned, the spring guides at rods 68 and springs 46 are not essential to the running of the engine, being useful to assist starting because they urge the piston plate towards the cam track for the first firing requirements The springs could also be replaced by hydraulic or pneumatic means if desired.

Engines as disclosed will therefore be found very effective in achieving the objects for which the invention has been devised. It can also run as a 2-stroke engine with the appropriate porting, combined with turbo or not. The engine will also operate as a diesel 4-stroke or 2-stroke or turbo etc. By moving the cam track or the rotating engine block (rotor assembly) closer or further from one another the compression ratio can be altered while the engine is running or while it is stopped, for the reasons of best economy and power under particular load conditions throughout the operating range, or in order to run the engine on alternate fuels at will. Due to the fact that there is no predetermined path which the engine is locked into, as with a crankshaft engine, it is possible to alter the cubic capacity of the engine while it is running or stopped, the resultant economy and power advantages thereof being obvious. The engine has no parts requiring support from oil pressure, and since no pressure is required, the engine can distribute oil to its moving arts due to its alternating pressures and without the aid of any pumps or moving parts.

The many design modifications set forth will illustrate that the embodiments are given by way of example only and may be subject to many further variations as will be readily apparent to persons skilled in the art and without departing from the scope and ambit of the invention, as defined by the appended claims.

I claim:

1. A rotary internal combustion engine of the type having pistons mounted for reciprocatory movement in respective cylinders which are arranged in equally-spaced relationship around a longitudinal axis of rotation, said axis being the axis of rotation of an output shaft passing rotatably and sealably through apertures of respective first and second end plates of a housing within which the pistons and cylinders move as part of a rotatable rotor assembly secured to said output shaft, while the pistons are simultaneously movable reciprocably in the cylinders, first cam follower means being associated with each piston and adapted to coact with undulating first cam track means around the housing, means being provided for conveying combustible fuel to, and for conveying exhaust gases from the operative ends of the bores of the cylinders whereby cyclical combustion of said fuel in said bores imparts reciprocation to the pistons with resultant thrust against the first cam track means so as to cause rotation of the rotor assembly and output shaft, the pistons including two sets thereof each having at least two pistons, the pistons of each set being spaced about the axis of rotation of the rotor assembly and output shaft and being interconneceted by piston-connection means so that the pistons of each set move in unison, the cam follower means and the undulating first cam track means being arranged so that movement of one set of pistons in their respective cylinders is generally in the direction opposite to the direction of movement of the other set of pistons; characterized in that the first cam follower means engage non-captively with the first cam track means.

2. A rotary internal combustion engine according to claim 1, and further characterized in that each piston-connection means is in the form of a piston mounting plate having an aperture through which the output shaft extends, means being provided whereby the piston mounting plate may be drivably connected to the output shaft as part of the rotor assembly while being permitted movement in the direction along said axis and output shaft to permit movement of the pistons in their respective cylinders.

3. A rotary internal combustion engine according to claim 2, and further characterized in that the means whereby each piston mounting plate may be drivably connected to the output shaft comprises longitudinal spline ribs along the output shaft engaging slidably in corresponding peripheral grooves about the said mounting plate aperture.

4. A rotary internal combustion engine according to claim 2, and further characterized in that the means whereby each piston mounting plate may be drivably connected to the output shaft comprises guide apertures in the mounting plate towards opposite ends thereof and adapted to receive slidably the free ends of guide pins disposed parallel to the output shaft axis and having their other ends rigidly connected to drive plate means forming part of the rotor assembly and secured to the output shaft.

5. A rotary internal combustion engine according to claim 4, and further characterized in that each mounting plate has three, four, or more arm sections extending radially relative to the output shaft and each having a piston mounted rigidly at its outer end, the pistons of each set being equally spaced with pistons of one set being between the adjacent pistons of the other set, all cylinders having their fuel-receiving operative ends in longitudinal register relative to the said axis of rotation.

6. A rotary internal combustion engine according to claim 5, and further characterized in that each cylinder comprises a cylinder member secured detachably in an engine block portion of the rotor assembly, the output shaft having affixing means whereby it may be fixed by pins or otherwise secured to said engine block portion of the rotor assembly.

7. A rotary internal combustion engine according to claim 1, and further characterized in that the first cam follower means includes a roller operatively connected to its respective piston for rotation at the non-operative end of its cylinder bore and said first cam track means has a continuous undulating face against which each roller engages only at that part of the periphery of each roller which is furthermost from its respective piston.

8. A rotary internal combustion engine according to claim 7, and further characterized in that each roller rotates about an axis at right angles to said output shaft axis, the rollers of all pistons being at the same distance from said output shaft axis and the cam track means being an annulus mounted on the inner face of said first end plate of the housing, the latter being the drive end of the engine at which the output shaft extends to permit its use as a drive shaft.

9. A rotary internal combustion engine according to claim 8, and further characterized in that the second end plate has external openings therein provided with fixed port means adapted to register with corresponding movable ports on the rotor assembly for admitting fuel to the operative ends of the cylinder bores, the second end plate being at the induction and exhaust end of the engine and constituting a mounting for fuel injector means, spark plug or equivalent means and exhaust outlet means.

10. A rotary internal combustion engine according to claim 9, and further characterized in that the second end plate has a pair of diametrally opposed spark plugs constituting said spark plug or equivalent means, a pair of diametrally opposed fuel injector assemblies constituting said fuel injector means, and a pair of diametrally opposed exhaust outlets constituting said exhaust outlet means, all said pairs being arranged at spaced intervals to coact with cylinder ports to permit successive intake, compression, power and exhaust functions of the pistons.

11. A rotary internal combustion engine according to claim 9, and further characterized in that the end of the output shaft at the induction and exhaust end of the engine is hollowed to provide coolant entry means, said shaft being rigid with the rotor assembly and having inlet passages from its hollow interior to the external periphery of each cylinder for cooling same, the rotor assembly having coolant collector means provided with sealing means whereby used coolant may be returned from the rotor assembly to the second end plate which is provided with coolant outlet means therefor.

12. A rotary internal combustion engine according claim 1, and further characterized in that each cylinder is adapted to receive fuel through an inlet port adapted to rotate with the rotor assembly into register with a respective port in the fixed housing, with face-to-face sliding contact in a plane perpendicular to the axis of the output shaft, sealing between the faces being effected by an annular sealing ring adapted to compress a resilient heat-resistant ring between its lower face and a recess of the cylinder port opening at a distance from the inner surface of the port substantially equal to the width of an upper recessed face of the sealing ring to enable balancing forces to be applied thereto by pressures in the cylinder port.

13. A rotary internal combustion engine according to claim 1, and further characterized in that each cylinder is adapted to receive fuel through an inlet port adapted to rotate with the rotor assembly into register with a respective port in the fixed housing, with face-to-face sliding contact in a plane perpendicular to the axis of the output shaft, sealing between the faces being effected by an annular sealing ring having an inner recess containing a tiltable spring steel or the like ring adapted under pressure to seal against the recess edge and maximise the sealing effect of said sealing ring.

14. A rotary internal combustion engine according to claim 1, and further characterized in that the housing has said first and a second cam track means associated with the first and second end plates respectively, and the rotor assembly has said first cam follower means co-acting with the first end plate in relation to reciprocatory motion of the pistons and has a second cam follower means co-acting with the second end plate in relation to reciprocatory motion of the cylinders.

15. A rotary internal combustion engine according to claim 14, and further characterized in that the first and second cam follower means are both constituted by rollers rotatable about axes at right angles to the axis of rotation of the output shaft.

16. A rotary internal combustion engine according to claim 1, and further characterized in that the housing includes a substantially cylindrical casing body connected sealably to and between the two housing end plates which are substantially circular when viewed in the direction along the axis of rotation.

17. A rotary internal combustion engine of the type having pistons mounted for reciprocatory movement in respective cylinders which are arranged in equally-spaced relationship around a longitudinal axis of rotation, said axis being the axis of rotation of an output shaft passing rotatably through an aperture of a first or drive end plate of two opposed end plates of a housing within which the pistons and cylinders move as part of a rotatable rotor assembly secured to said output shaft, while the pistons are simultaneously movable reciprocably in the cylinders, cam follower means being associated with each piston and adapted to coact with undulating cam track means around the housing, means being provided for conveying combustible fuel to, and for conveying exhaust gases from the operative ends of the bores of the cylinders whereby cyclical combustion of said fuel in said bores imparts reciprocation to the pistons with resultant thrust against the cam track means so as to cause rotation of the rotor assembly and output shaft, the pistons including two sets thereof each having at least two pistons, the pistons of each set being spaced about the axis of rotation of the rotor assembly and output shaft and being interconnected by piston-connection means so that they move in unison, the said cam follower means and the undulating cam track means being arranged so that movement of one set of pistons in their respective cylinders is generally in the direction opposite to the direction of movement of the other set of pistons; characterized in that each set of pistons includes two or more pairs of pistons with the pistons of each pair being at opposite sides of the axis of rotation of the rotor assembly and output shaft and the pistons of one pair of each set are on the power stroke at the time when the pistons of another pair of the same set are on the intake stroke.

18. A rotary internal combustion engine of the type having pistons mounted for reciprocatory movement in respective cylinders which are arranged in equally-spaced relationship around a longitudinal axis of rotation, said axis being the axis of rotation of an output shaft passing rotatably through an aperture of a first or drive end plate of two opposed end plates of a housing within which the pistons and cylinders move as part of a rotatable rotor assembly secured to said output shaft, while the pistons are simultaneously movable reciprocably in the cylinders, cam follower means being associated with each piston and adapted to coact with undulating cam track means around the housing, means being provided for conveying combustible fuel to, and for conveying exhaust gases from the operative ends of the bores of the cylinders whereby cyclical combustion of said fuel in said bores imparts reciprocation to the pistons with resultant thrust against the cam track means so as to cause rotation of the rotor assembly and output shaft, the pistons including two sets thereof each having at least two pistons, the pistons of each set being spaced about the axis of rotation of the rotor assembly and output shaft and being interconnected by piston-connection means so that they move in unison, the cam follower means and the undulating cam track means being arranged so that movement of one set of pistons in their respective cylinders is generally in the direction opposite to the direction of movement of the other set of pistons; characterized in that the parts are so made and arranged that the piston cam follower means coact with the cam track means in a manner which causes movement of each set of pistons in their respective cylinders for the compression and/or exhaust strokes but not for the intake and/or power strokes.

19. A rotary internal combustion engine according to claim 18, further characterized in that the pistons are arranged in two sets of two or more pairs with the pistons of each pair being at opposite sides of the axis of rotation of the rotor assembly and output shaft and the pistons of one pair of each set are on the power stroke at the time when the pistons of another pair of the same set are on the intake stroke, the pistons on the power stroke causing the pistons on the intake stroke to move in their respective cylinders.

20. A rotary internal combustion engine of the type having pistons mounted for reciprocatory movement in respective cylinders which are arranged in equally-spaced relationship around a longitudinal axis of rotation, said axis being the axis of rotation of an output shaft passing rotatably and sealably through apertures of respective first and second end plates of a housing within which the pistons and cylinders move as part of a rotatable rotor assembly secured to said output shaft, while the pistons are simultaneously movable reciprocably in the cylinders, cam follower means being associated with each piston and adapted to coact with undulating cam track means around the housing, means being provided for conveying combustible fuel to, and for conveying exhaust gases from the operative ends of the bores of the cylinders whereby cyclical combustion of said fuel in said bores imparts reciprocation to the pistons with resultant thrust against the cam track means so as to cause rotation of the rotor assembly and output shaft, the pistons including two sets thereof each having at least two pistons, the pistons of each set being spaced about the axis of rotation of the rotor assembly and output shaft and being interconnected by piston-connection means so that the pistons of each set move in unison, the cam follower means and the undulating cam track means being arranged so that movement of one set of pistons in their respective cylinders is generally in the direction opposite to the direction of movement of the other set of pistons; characterized in that the cam follower means engages only with a face of the cam track means that generally faces the respective pistons.

* * * * *